US008283846B2

(12) United States Patent
Shibata et al.

(10) Patent No.: US 8,283,846 B2
(45) Date of Patent: Oct. 9, 2012

(54) SPARK PLUG CONTAINING SPECIFIC RATIO CONTENT

(75) Inventors: Tsutomu Shibata, Owariasahi (JP); Takehito Kuno, Nagoya (JP); Tomoo Tanaka, Kitanagoya (JP); Kenji Nunome, Nagoya (JP); Shoichiro Nagatomo, Toyoake (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/259,219

(22) PCT Filed: Oct. 15, 2010

(86) PCT No.: PCT/JP2010/006146

§ 371 (c)(1),
(2), (4) Date: Sep. 23, 2011

(87) PCT Pub. No.: WO2011/077619

PCT Pub. Date: Jun. 30, 2011

(65) Prior Publication Data

US 2012/0013241 A1 Jan. 19, 2012

(30) Foreign Application Priority Data

Dec. 24, 2009 (JP) ..... 2009-292950

(51) Int. Cl.
*H01T 13/20* (2006.01)
*F02P 13/00* (2006.01)

(52) U.S. Cl. ..... 313/118; 313/141

(58) Field of Classification Search ..... None
See application file for complete search history.

(56) References Cited

U.S. PATENT DOCUMENTS 8,044,562 B2 * 10/2011 Musasa et al. ..... 313/141
2006/0170320 A1 8/2006 Kumagai et al.

(Continued)

FOREIGN PATENT DOCUMENTS

EP 1 867 739 A1 12/2007

(Continued)

OTHER PUBLICATIONS

International Search Report [PCT/ISA/210], dated Jan. 11, 2011, issued in Application No. PCT/JP2010/006146 from the International Searching Authority.

(Continued)

*Primary Examiner* — Natalie Walford
(74) *Attorney, Agent, or Firm* — Sughrue Mion, PLLC

(57) ABSTRACT

The object of the invention is to provide a spark plug including a central electrode and/or a ground electrode with a gap, which can suppress generation of corrosion-like generated foreign substances while maintaining high thermal conductivity and high strength. The gap between the central electrode and the ground electrode with at least one of the central electrode and the ground electrode formed from an electrode material including 96% by mass or more of Ni, in which the electrode material includes a total content of from 0.05% by mass to 0.45% by mass of at least one selected from a group consisting of Y and rare earth elements, 0.05% by mass or more of Mn, and a total content of 0.01% by mass or more of at least one selected from a group consisting of Ti, V, and Nb, and the ratio (a/b) of the total content (a) of Ti, V, and Nb to the content (b) of Mn is from 0.02 to 0.40.

9 Claims, 2 Drawing Sheets

U.S. PATENT DOCUMENTS

| | | | |
|---|---|---|---|
| 2009/0107440 | A1 | 4/2009 | Lykowski et al. |
| 2010/0264796 | A1 | 10/2010 | Musasa et al. |
| 2011/0012500 | A1 | 1/2011 | Kumagai et al. |

FOREIGN PATENT DOCUMENTS

| | | | |
|---|---|---|---|
| JP | 48-25125 | | 3/1973 |
| JP | 63-018033 | A | 1/1988 |
| JP | 2-163335 | A | 6/1990 |
| JP | 8-232030 | A | 9/1996 |
| JP | 2587864 | B2 | 3/1997 |
| JP | 2004-206892 | A | 7/2004 |
| JP | 2004-206931 | A | 7/2004 |
| JP | 2006-236977 | A | 9/2006 |
| JP | 2006-316343 | A | 11/2006 |
| JP | 2007-092139 | A | 4/2007 |
| WO | 2009/063914 | A1 | 5/2009 |

OTHER PUBLICATIONS

Written Opinion [PCT/ISA/237], dated Jan. 11, 2011, issued in Application No. PCT/JP2010/006146 from the International Searching Authority.

* cited by examiner

SPARK PLUG CONTAINING SPECIFIC RATIO CONTENT

TECHNICAL FIELD

The present invention relates to a spark plug, and particularly to a spark plug using a Ni base alloy as an electrode material.

BACKGROUND ART

In general, a spark plug used for ignition of internal combustion engines, such as automobile engines or the like includes a cylindrical metal shell, a cylindrical insulator disposed at the inner hole of the metal shell, a central electrode disposed at the inner hole in the leading end side of the insulator, and a ground electrode provided in a manner in which one end is in contact with the leading end side of the metal shell and the other end forms a spark discharge gap with the central electrode. Additionally, in the combustion chamber of an internal combustion engine, a spark plug brings about spark discharge at the spark discharge gap formed between the leading end of the central electrode and the leading end of the ground electrode, and combusts a fuel supplied in the combustion chamber.

As an electrode material of such a spark plug, a variety of Ni base alloys which are excellent in terms of oxidation resistance, spark corrosion resistance, or the like are widely used. For example, Patent Document 1 describes "Ni base alloy ignition plug electrode constituted by a Ni base alloy having a composition (hereinafter, % by mass) Cr: 0.5% to 5%, Mn: 0.1% to 3%, Si: 0.1% to 3%, Y: 0.00001% to 0.5% with the balance consisting of Ni and inevitable impurities." Patent Document 2 describes "an electrode material for ignition plugs composed of, by % by mass, C: 0.1% or less (including 0), Si: 0.3% to 3.0%, Mn: less than 0.5% (including 0), Cr: less than 0.5% (including 0), Al: 0.3% or less (including 0) and a total content of 0.005% to 10% of one or two of Hf and Re with the balance consisting of Ni and inevitable impurities." Patent Document 3 describes "an electrode for ignition plugs using a Ni base alloy including, by the mass ratio, Cr: 0.5% to 3%, Si: 0.3% to 2.5%, Mn: 0.5% to 1.8% (wherein 0.5% and 1.8% are not included) and Al: 0.05% to 2.5% (wherein 0.05% is not included) with the balance consisting of Ni and inevitable impurities, in which the ratio of Si to Cr (Si/Cr) is less than 1.1."

However, in recent years, since there has been increasing demand for the prevention of global warming, conservation of fossil fuels, or the like, measures have been sought such as setting a large air-fuel ratio for fuel mileage improvement, or the like in the internal combustion engine of automobiles or the like. In such an internal combustion engine, there is a tendency that the temperature in the combustion chamber, in particular, near the area where the leading end of the central electrode and the leading end of ground electrode are located, is increased and the oxygen concentration in the combustion chamber is increased. Furthermore, since the sizes of the central electrode and the ground electrode are decreased due to the decreasing size of a spark plug, it becomes impossible to make the heat generated by discharge be transferred to the metal shell via the insulator and packing by the central electrode and to the metal shell by the ground electrode and then be removed (sometimes called heat dissipation), and therefore the temperatures at the central electrode and the ground electrode also become liable to increase.

If a spark plug is used in such an environment of a high temperature and a high oxygen concentration, and therefore the temperatures of the central electrode and the ground electrode are also liable to increase, it becomes difficult to maintain a desired performance in spark plugs of the related art. For example, there sometimes occurs a phenomenon called 'pre-ignition' in which a high temperature electrode acts as a source of ignition before regular ignition so that a fuel is ignited.

RELATED ART DOCUMENT

Patent Document

[Patent Document 1] JP-A-S63-18033
[Patent Document 2] JP-A-2007-92139
[Patent Document 3] JP-A-H02-163335

SUMMARY OF INVENTION

Problem that the Invention is to Solve

Hence, a variety of studies were carried out to provide a high performance spark plug with no abnormal phenomena, such as pre-ignition or the like, and it was found that, in an environment with a high temperature and a high oxygen concentration, a plurality of fine lump-like corrosion-like generated foreign substances, which is considered to be formed by a reaction between deposits adhered to an electrode, that is, an adhered substance, such as oil, uncombusted fuel, or the like, and an electrode material, is sometimes formed so as to cover the electrode surface (refer to FIG. 3), and the corrosion-like generated foreign substances have an influence on the ignition properties. If the corrosion-like generated foreign substances are formed, the spark discharge gap provided between the central electrode and the ground electrode is narrowed, and thus there is a concern in that ignition properties may be degraded. In the worst case, short-circuit may be caused between the central electrode and the ground electrode, which results in misfire of an engine. In addition, since the thermal conductivity of the electrodes is degraded and thus the heat dissipation becomes poor, there is an additional concern in that the electrodes may act as a source of ignition so as to induce pre-ignition.

The object of the invention is to provide a spark plug including a central electrode and/or a ground electrode, which can suppress generation of corrosion-like generated foreign substances while maintaining high thermal conductivity and high strength.

Solution to Problem

A solution to the above problems is (1) a spark plug including a central electrode and a ground electrode provided to have a gap between the central electrode and the ground electrode with at least one of the central electrode and the ground electrode formed from an electrode material including 96% by mass or more of Ni, in which the electrode material includes a total content of from 0.05% by mass to 0.45% by mass of at least one selected from a group consisting of Y and rare earth elements, 0.05% by mass or more of Mn, and a total content of 0.01% by mass or more of at least one selected from a group consisting of Ti, V, and Nb, and the ratio (a/b) of the total content (a) of Ti, V, and Nb to the content (b) of Mn is from 0.02 to 0.40.

A preferable embodiment of the above (1) is a spark plug, in which (2) the ratio (a/b) is from 0.03 to 0.29, and more preferably from 0.04 to 0.14,
(3) the electrode material includes from 0.15% by mass to 1.5% by mass of Si,
(4) the electrode material includes from 0.01% by mass to 0.1% by mass of Al,
(5) the electrode material includes from 0.05% by mass to 0.5% by mass of Cr,
(6) the electrode material includes 0.005% by mass or more of C,
(7) the electrode material includes Ti, and
(8) at least the ground electrode is formed from the electrode material.

Advantageous Effects of Invention

Since the spark plug according to the invention includes, in a high Ni-based alloy, a specific amount of at least one selected from a group consisting of Y and rare earth elements, Mn, and at least one selected from a group consisting of Ti, V, and Nb, and includes a central electrode and/or a ground electrode formed from an electrode material with the ratio (a/b) of the total content (a) of Ti, V, and Nb to the content (b) of Mn in a specific range, it is possible to provide a spark plug which can suppress generation of corrosion-like generated foreign substances while maintaining high thermal conductivity and high strength, and includes a central electrode and a ground electrode.

In addition, if the electrode material further includes a specific amount of Si, Al, and/or Cr, it is possible to further suppress generation of corrosion-like generated foreign substances.

In addition, if the electrode material further includes a specific amount of C, it is possible to obtain higher strength and to prevent breakage and deformation of an electrode.

Furthermore, if the ground electrode, which has a higher temperature than the central electrode and is also liable to be exposed to deposits, is formed from the electrode material, the effect of the present invention is further enhanced.

DESCRIPTION OF EMBODIMENTS

The spark plug according to the invention has a central electrode and a ground electrode arranged such that one end of the central electrode and one end of the ground electrode face each other with a gap therebetween. The spark plug according to the invention can adopt a variety of well-known configurations with no particular limitation on the other configurations as long as a spark plug has the above configuration.

Figure 1A:
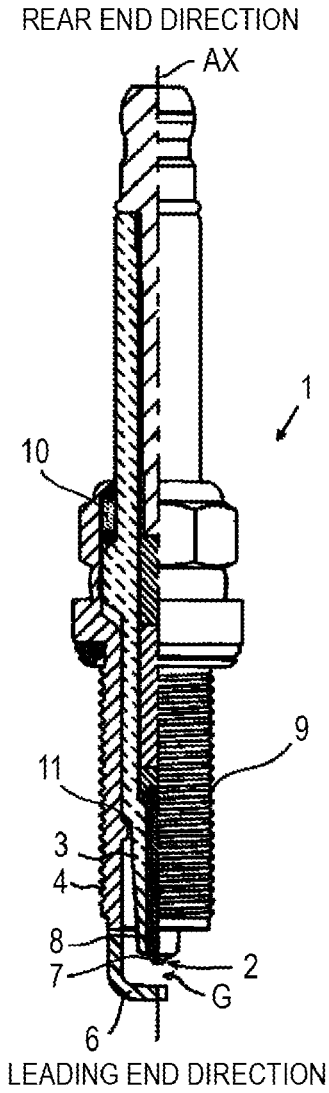
FIG. 1 (*a*) and FIG. 1 (*b*) are explanatory views explaining a spark plug which is an example of the spark plug according to the invention, in which FIG. 1(*a*) is an overall explanatory view of the cross section of a part of the spark plug which is an example of the spark plug according to the invention, and FIG. 1(*b*) is an explanatory view of a cross section showing the main parts of the spark plug which is an example of the spark plug according to the invention.
Figure 1B:
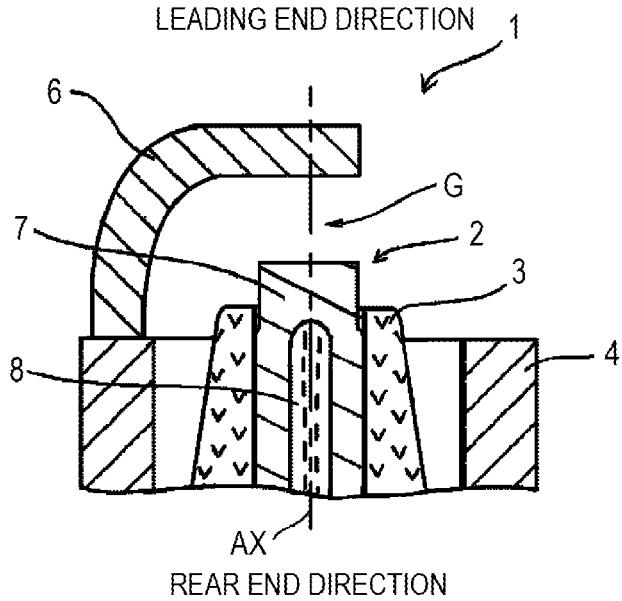

FIG. 1 shows a spark plug which is an example of the spark plug according to the invention. FIG. 1(*a*) is an overall explanatory view of the cross section of a part of the spark plug 1 which is an example of the spark plug according to the invention, and FIG. 1(*b*) is an explanatory view of a cross section showing the main parts of the spark plug 1 which is an example of the spark plug according to the invention. Here, description will be made on the assumption that direction of the bottom of the paper is the leading end direction of the axis AX and the direction of the top of the paper is the rear end direction of the axis AX in FIG. 1(*a*), and the direction of the top of the paper is the leading end direction of the axis AX and the direction of the bottom the paper is the rear end direction of the axis AX in FIG. 1(*b*).

As shown in FIGS. 1(*a*) and 1(*b*), the spark plug 1 includes a substantially stick-shaped central electrode 2, a substantially cylindrical insulator 3 provided at the outer circumference of the central electrode a substantially cylindrical metal shell 4 that supports the insulator 3, and a ground electrode 6 arranged with one end thereof to face the leading end surface of the central electrode 2 with a spark discharge gap G therebetween and the other end thereof connected to the end surface of the metal shell 4.

The metal shell 4 has a substantially cylindrical shape and is formed to include the insulator 3 therein so as to support the insulator 3. A screw portion 9 is formed on the outer circumference surface of the metal shell 4 in the leading end direction, and the screw portion 9 is used to mount the spark plug 1 on a cylinder head in an internal combustion engine, which is not shown. The metal shell 4 can be formed from an electrically conductive steel material, such as a low carbon steel.

The insulator 3 is supported by the inner circumference portion of the metal shell 4 via a tarc 10, a packing 11 or the like, and has an axis hole that supports the central electrode 2 along the axis direction of the insulator 3. The insulator 3 is fixed to the metal shell 4 in a state in which the end portion of the insulator 3 in the leading end direction is projected from the leading end surface of the metal shell 4. The insulator 3 is preferably a material having mechanical strength, thermal strength, and electrical strength, and examples of such a material include a ceramic sintered body with alumina as the main body.

The central electrode 2 is formed from an external material 7 and an internal material 8 formed to be implanted at the axis center portion inside the external material 7 concentrically with the external material 7. The central electrode 2 is fixed to an axis hole in the insulator 3 in a state in which the leading end portion is projected from the leading end surface of the insulator 3, and is insulated and supported with respect to the metal shell 4. The central electrode 2 is formed from the electrode material to be described or a well-known material other than the electrode material, and, particularly, the external material 7 of the central electrode 2 may be formed from the electrode material to be described.

The ground electrode 6 is formed into, for example, a substantially prismatic body and is provided in a shape and a structure in which the ground electrode 6 has an end connected to the end surface of the metal shell 4, a middle portion bent substantially like the letter 'L', and the leading end portion located in the axis direction of the central electrode 2. Since the ground electrode 6 is provided in the above manner, one end of the ground electrode 6 is arranged so as to face the central electrode 6 through the spark discharge gap G. The spark discharge gap G is a gap between the leading end surface of the central electrode 2 and the surface of the ground electrode 6, and the spark discharge gap G is generally set to from 0.3 mm to 1.5 mm. The ground electrode 6 may be formed from the electrode material to be described below or a well-known material other than the electrode material, but, generally, the ground electrode 6 is exposed to a high temperature rather than the central electrode 2, and therefore the ground electrode 6 is preferably formed from the electrode material to be described below.

As described above, in the spark plug 1, at least one of the central electrode 2 and the ground electrode 6 is formed from the electrode material described below, and, preferably, the ground electrode 6, which reaches a higher temperature, is formed from the electrode material described below.

As the electrode material, low Ni-based alloys, such as INCONEL 600, INCONEL 601 (both are trade names), or the like including from 50% by mass to 85% by mass of high Ni-based alloys including 95% by mass or more of Ni and from 10% by mass to 42% by mass of Cr and Fe are widely known. In the invention, studies have been made of high Ni-based alloys so that the invention of the present application has been completed.

The electrode material forming the electrodes includes 96% by mass or more of Ni, a total content of from 0.05% by mass to 0.45% by mass of at least one selected from a group consisting of Y and rare earth elements, 0.05% by mass or more of Mn, and a total content of 0.01% by mass or more of at least one selected from a group consisting of Ti, V, and Nb, for which the ratio (a/b) of the total content (a) of Ti, V, and Nb to the content (b) of Mn is from 0.02 to 0.40.

If the content of Ni in the electrode material is less than 96% by mass, the thermal conduction rate of the electrode material is degraded, and therefore electrodes cannot effectively release heat generated by discharge, which puts a discharge portion at a high temperature at all times, and, consequently, oxidative loss of the electrode occurs. In addition, due to an increase in the electrode temperature, sometimes pre-ignition occurs in which a high temperature electrode acts as an ignition source before a regular ignition so that a fuel is ignited. The content of Ni is preferably 96% by mass or more from the standpoint of the capability of maintaining high thermal conduction rate of the electrode material.

If the total content of at least one selected from a group consisting of Y and rare earth elements in the electrode material is less than 0.05% by mass, exposure of an electrode to a high temperature makes the structure of the electrode material liable to grow as particles, and therefore the electrode becomes liable to be broken or deformed. In addition, if the total content exceeds 0.45% by mass, the electrode material reacts with deposits adhered to the electrode, that is, an adhered substance, such as oil, uncombusted fuel, or the like, and thus a unique phenomenon is liable to occur in which numerous fine lump-like corrosion-like generated foreign substances are formed so as to cover the surface of the electrode. If such corrosion-like generated foreign substances are formed, the gap between the leading end surface of the central electrode 2 and the surface of the ground electrode 6 which faces the leading end surface of the central electrode 2 is narrowed down, and thus there is a concern of degradation of ignition properties. In the worst case, short-circuit may be caused between the central electrode and the ground electrode, which results in misfire of an engine. In addition, if corrosion-like generated foreign substances are generated, since the thermal conductivity of an electrode is degraded and thus the heat dissipation becomes poor, there is a concern of induction of pre-ignition.

Examples of the rare earth elements include Nd, La, Ce, Dy, Er, Yb, Pr, Pm, Sm, Eu, Gd, Tb, Ho, Tm, and Lu.

If the content of Mn in the electrode material is 0.05% by mass or more, since a robust oxidation film is formed on the surface of an electrode formed from the electrode material, the oxidation resistance of the electrode is improved. An oxidation film formed by Mn effectively acts with respect to oxidation resistance. However, if an electrode is exposed to a high temperature and high oxygen concentration environment, there are cases in which corrosion-like generated foreign substances are generated at the surface of the electrode. The corrosion-like generated foreign substances are considered to be formed by a reaction between C included in deposits adhered to the electrode and an oxidation film formed from Mn due to the fact that the electrode is placed in a high temperature and high oxygen concentration environment. If the corrosion-like generated foreign substances are generated so as to cover the surface of the electrode, as described above, normal ignition does not occur.

As a result, it was found that, if the electrode material includes at least one selected from a group consisting of Ti, V, and Nb in addition to Mn, it is possible to suppress formation of corrosion-like generated foreign substances. It is presumed that, if the electrode material includes at least one selected from a group consisting of Ti, V, and Nb, at least one selected from a group consisting of Ti, V, and Nb traps C derived from deposits intruded in an oxidation film so that generation of corrosion-like generated foreign substances formed by reaction between C and the oxidation film of Mn is suppressed. For example, Ti trapping C forms TiC. Since TiC does not react with the oxidation film of Mn and forms no compound, it becomes possible that the oxidation film of Mn can be stably present without lowering the melting point. As a result, it is considered that it becomes difficult for corrosion-like generated foreign substances to be formed.

Therefore, in order to achieve the object of the invention, it is important not only to have the content of Mn and the total content of at least one selected from a group consisting of Ti, and Nb in the electrode material in predetermined ranges, but also to have a ratio of the total content of Ti, V, and Nb to the content of Mn in a specific range. That is, if the electrode material includes 0.05% by mass or more of Mn, and 0.01% by mass or more of at least one selected from a group consisting of Ti, V, and Nb, and the ratio (a/b) of the total content (a) of Ti, V, and Nb to the content (b) of Mn is from 0.02 to 0.40, formation of corrosion-like generated foreign substances is suppressed.

Furthermore, there are cases in which the electrode material, in consideration of embodiments, includes 0.07% by mass or more of Mn and also includes 3% by mass or less, and includes a total content of 0.02% by mass or more of at least one selected from a group consisting of Ti, V, and Nb and also includes 0.1% by mass or less.

The ratio (a/b) is preferably from 0.03 to 0.29, and particularly preferably from 0.04 to 0.14. If the ratio (a/b) is in the above range, formation of corrosion-like generated foreign substances is further suppressed.

Any of the Ti, V, and Nb is considered to have an operation of trapping C derived from deposits and thus has an effect of suppressing formation of corrosion-like generated foreign substances, but, among them, it is particularly preferable to include Ti from the standpoint of economic efficiency.

The electrode material preferably includes Si, and particularly preferably includes from 0.15% by mass to 1.5% by mass of Si.

The electrode material preferably includes Al, and particularly preferably includes from 0.01% by mass to 0.1% by mass of Al.

The electrode material preferably includes Cr, and particularly preferably includes from 0.05% by mass to 0.5% by mass of Cr.

If the electrode material includes Si, Al, and/or Cr, the oxidation film of Mn becomes more robust. Therefore, if the electrode material includes Si, Al, and/or Cr, particularly in the above range, since the oxidation resistance is improved, and it also becomes difficult for C derived from deposits in the oxidation film of Mn to intrude, it is possible to further effectively suppress generation of corrosion-like generated foreign substances.

The electrode material preferably includes C, and particularly preferably includes 0.005% by mass or more. If the content of C in the electrode material is 0.005% by mass or more, the mechanical strength of the electrode material in a high temperature environment can be secured, and it is possible to prevent breakage and deformation of an electrode. From the standpoint of securing the mechanical strength of an electrode even when the electrode is exposed to a high temperature environment, the heat dissipation of the electrode is degraded, and the electrode temperature is increased, the content of C is 0.005% by mass or more, and more preferably from 0.01% by mass to 0.05% by mass.

The electrode material substantially includes at least one selected from a group consisting of Ni, Y, and rare earth elements, Mn, at least one selected from a group consisting of Ti, V, and Nb, and, according to desire, Si, Al, Cr, and/or C. Each of these components is included within the above-described range of the content of each component so that the total content of the components and inevitable impurities becomes 100% by mass. There are cases in which components other than the above components, for example, S, P, Fe, Cu, B, Zr, Mg, and/or Ca, are included as a trace amount of inevitable impurities. The content of the inevitable impurities is preferably small, but the inevitable impurities may be included as long as the object of the invention can be achieved, and, when the total mass of the above-described components is set to 100 parts by mass, it is preferable that the ratio of one kind of the above-described inevitable impurities is 0.1 parts by mass or less, and the total ratio of all kinds of inevitable impurities included is 0.2 parts by mass or less.

The content of each component included in the electrode material can be measured in the following manner. That is, when the electrode material is made into an electrode, specimens are taken from portions other than molten portions formed when the electrode and the metal shell and/or other member, such as precious metal chips or the like, are melted and adhered (0.3 g or more is desirable for carbon sulfur analysis, and 0.2 g or more is desirable for ICP emission spectrometry), and analysis is performed by carbon sulfur analysis for the content of C and Inductively Coupled Plasma (ICP) emission spectrometry for other components. Ni is calculated as the remainder using the above analysis measured values. In the carbon sulfur analysis, the sampled specimens are thermally decomposed in a combustion furnace and then detected with non-dispersion infrared ray so as to measure the content of C (for example, EMIA-920V, trade name, manufactured by Horiba Ltd., can be used as a carbon sulfur analysis apparatus). In the ICP emission spectrometry, specimens are brought into a solution by the acid hydrolysis method (for example, nitric acid), subjected to a qualitative analysis and then a quantitative analysis of detected elements and designated elements (for example, iCAP-6500, trade name, manufactured by Thermo Fisher Scientific K.K., can be used as an ICP emission spectrometry apparatus). In any of the analyses, the average value of three measurement values is calculated, and the average value is considered as the content ratio of each component in the electrode material.

Meanwhile, the electrode material is produced in the following manner by mixing predetermined raw materials in a predetermined mixing ratio. The composition of a produced electrode material almost matches the composition of the raw materials. Therefore, the content of each component included in the electrode material can be calculated from the mixing ratio of the raw materials in a simple method.

If the above-described electrode material is used for at least one of the central electrode and the ground electrode in a spark plug, particularly for the ground electrode, it is possible to suppress formation of corrosion-like generated foreign substances while maintaining high thermal conductivity and mechanical strength even when the electrodes are exposed to an atmosphere of high temperature and high oxygen concentration, and, furthermore, accompanying the miniaturization of a spark plug, the cross-sections of the central electrode and the ground electrode are decreased. If an electrode has a high thermal conductivity, since heat generated by discharge can be transferred rapidly to the metal shell, it is possible to prevent oxidative loss of the electrode due a temperature rise in the electrode. In addition, since, along with the demand for improvement in combustion efficiency, internal combustion engines tend to have high temperature and high oxygen concentration, and the mechanical strength of the electrodes is maintained even at high temperatures, it is possible to prevent breakage and deformation during use. Furthermore, since it is possible to suppress formation of corrosion-like generated foreign substances, if corrosion-like generated foreign substances are formed, there are concerns that the gap between the end surface of the central electrode and the surface of the ground electrode which faces the central electrode may be narrowed, and ignition properties may be degraded, and, in the worst case, the central electrode and the ground electrode may short-circuit, and the engine accidentally catches fire, and therefore such poor ignition can be suppressed. In addition, if corrosion-like generated foreign substances are formed, since there are concerns that the thermal conductivity of electrodes may be degraded and the heat dissipation may be degraded so that the electrodes act as a source of ignition so as to induce pre-ignition, it is possible to prevent such phenomena.

The above spark plug 1 is manufactured, for example, in the following manner. Firstly, an electrode material including a content of each component within the above-described range is adjusted by dissolving 96% by mass or more of Ni, a total content of from 0.05% by mass to 0.45% by mass of at least one selected from a group consisting of Y and rare earth elements, 0.05% by mass or more of Mn, and a total content of 0.01% by mass or more of at least one selected from a group consisting of Ti, V, and Nb, and, according to desire, from 0.15% by mass to 1.5% by mass of Si, from 0.01% by mass to 0.1% by mass of Al, from 0.05% by mass to 0.5% by mass of Cr, and 0.0005% by mass or more of C. Meanwhile, in the electrode material, the ratio (a/b) of the total content (a) of Ti, V, and Nb to the content (b) of Mn is adjusted to from 0.02 to 0.40.

Figure 2A:
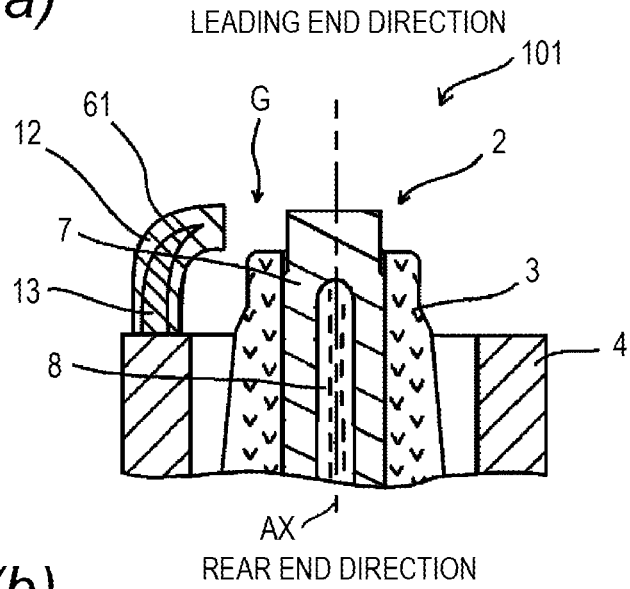
FIG. 2(*a*) is an explanatory view of a cross section showing the main parts of the spark plug which is another example of the spark plug according to the invention, and FIG. 2(*b*) is an explanatory view of a cross section showing the main parts of the spark plug which is the other example of the spark plug according to the invention.
Figure 2B:
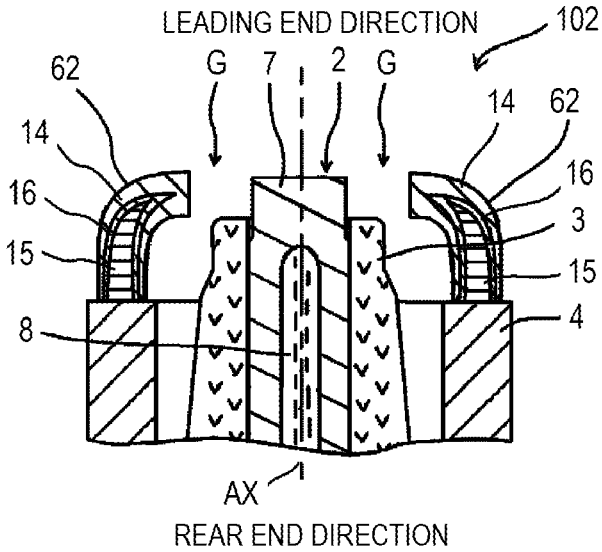
Figure 3:
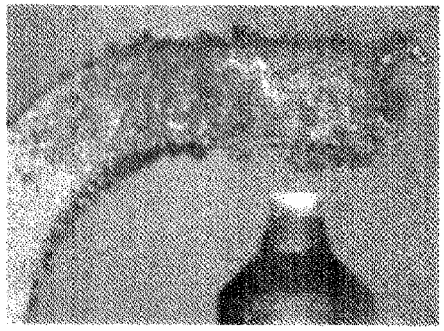
FIG. 3 is a photo of corrosion-like generated foreign substances formed in a spark plug in the related art.

The electrode material adjusted in the above manner is processed into a predetermined shape so as to manufacture the central electrode 2 and/or the ground electrode 6. It is possible to continuously perform the adjustment and processing of the electrode material. For example, it is possible to manufacture the central electrode 2 and/or the ground electrode 6 by preparing molten metals of alloys having desired compositions using a vacuum melting furnace, preparing an ingot from each molten metal via vacuum casting, and then appropriately adjusting the ingots into predetermined shapes and predetermined dimensions via a hot process, a wire drawing process, or the like. Meanwhile, it is also possible to form the central electrode 2 by inserting an internal material 8 to an external material 7 formed into a cup shape and then perform a plastic working, such as an extrusion process or the like. In addition, as shown in FIG. 2(*a*), when the ground electrode 61 is formed from an external layer 12 and an axis portion 13 provided in a manner in which the axis portion 13 is implanted in the axis center portion of the external layer 12, it is possible to manufacture the ground electrode 61 by inserting the axis portion 13 to the external layer 12 formed into a cup shape, performing a plastic working, such as an extrusion process or the like, and then performing a plastic working to obtain a substantially prismatic body shape.

Next, one end of the ground electrode 6 is connected to the end surface of the metal shell 4 formed via a plastic working or the like into a predetermined shape via electrical resistance welding, laser welding, or the like. Zn plating or Ni plating is performed on the metal shell to which the ground electrode has been connected. After Zn plating or Ni plating, a trivalent chromate treatment may be performed. In addition, the ground electrode may have plating adhered thereto, may have a mask to prevent plating from being adhered to the ground electrode, or plating adhered to the ground electrode may be separately peeled off. Subsequently, the insulator 3 is manufactured by firing ceramics or the like into a predetermined shape, combining the central electrode 2 to the insulator 3 via a well-known method, and the insulator 3 is combined to the metal shell 4 to which the ground electrode 6 has been connected. Additionally, the spark plug 1 is manufactured by bending the leading end of the ground electrode 6 toward the central electrode 2 so that one end of the ground electrode 6 faces the leading end of the central electrode 2.

The spark plug according to the invention is used as a spark plug of an internal combustion engine of a vehicle, for example, a gasoline engine or the like, and is fixed to a predetermined position via the screw portion 9 engaged with screw holes provided in heads (not shown) partitioned in the combustion chamber of an internal combustion engine. The spark plug according to the invention can be used for all internal combustion engines, but since the central electrode and/or the ground electrode which can suppress formation of corrosion-like generated foreign substances while maintaining high thermal conductivity and high strength is included, the spark plug can be preferably used particularly for internal combustion engines having high temperatures and a high oxygen concentration.

The spark plug 1 according to the invention is not limited to the above embodiments and can be modified in various manners within a scope in which the object of the invention can be achieved. For example, the spark plug 1 has the leading end surface of the central electrode 2 and the surface of one end of the ground electrode 6 arranged to face each other in the axis direction of the central electrode 2 with the spark discharge gap G therebetween, but, in the invention, as shown in FIGS. 2(*a*) and (2)*b*, the side surface of the central electrode 2 and the surface of one end of the ground electrode 61 or may be arranged to face each other in the radius direction of the central electrode 2 with the spark discharge gap G therebetween. In this case, the number of the ground electrodes 61 or 62 provided, which face the side surface of the central electrode 2, may be a single as shown in FIG. 2(*a*) or plural as shown in FIG. 2(*b*).

In addition, the spark plug 1 has the central electrode 2 and the ground electrode 6, both of which are formed from the electrode material, but, in the invention, only the central electrode may be formed from the electrode material or only the ground electrode may be formed from the electrode material. In the spark plug according to the invention, generally, the ground electrode is exposed to a high temperature rather than the central electrode, and therefore it is preferable to form at least the ground electrode from the electrode material. Meanwhile, when the central electrode 2 is formed from a material other than the electrode material, for example, the external material is formed from a well-known Ni alloy or the like other than the electrode material, the internal material 8 is formed from a metallic material excellent in terms of thermal conductivity, such as Cu, Ag, or the like.

As shown in FIG. 1(*b*), the spark plug 1 has the ground electrode 6, all of which is formed from the electrode material, but, as shown in FIG. 2(*a*), the ground electrode 61 may be formed from the external layer 12 and the axis portion 13 provided in a manner in which the axis portion 13 is implanted concentrically to the axis center portion inside the external layer 12, and the external layer 12 and the axis portion 13 may be formed from the electrode material and a metallic material including Cu as the main component, respectively. Alternatively, as shown in FIG. 2(*b*), the ground electrode 62 may be formed from an external layer 14, an axis portion 15 provided in a manner in which the axis portion 15 is implanted concentrically to the axis center portion inside the external layer 14, and an intermediate layer 16 provided between the axis portion 15 and the external layer 14 as if covering the axis portion 15, and the external layer 14, the intermediate layer 16, and the axis portion 15 may be formed from the electrode material, a metallic material including Cu as the main component, and a metallic material including Ni as the main component, respectively. The ground electrode having such a structure has good heat dissipation and can effectively lower the temperature of the ground electrode which has reached a high temperature.

Furthermore, the spark plug 1 includes the central electrode and the ground electrode 6, but, in the invention, either or both of the leading end surface portion of the central electrode and the surface of the ground electrode may also include a precious metal chip. The precious metal chips formed on the leading end portion of the central electrode and the surface of the ground electrode generally have a cylindrical or prismatic shape and appropriately adjusted dimensions, and are fixed by melting to the leading end portion of the central electrode and the surface of the ground electrode via an appropriate welding method, for example, laser welding or electrical resistance welding. In this case, a gap formed between the surfaces of two facing precious metal chips or a gap between the surface of the precious metal chip and the central electrode 2 which faces the precious metal chip or the surface of the ground electrode 6 becomes the spark discharge gap. Examples of materials forming the precious metal chip include precious metal of Pt, Pt alloys, Ir, Ir alloys, or the like.

EXAMPLES

Manufacturing of Spark Plug Specimens

Using a general vacuum melting furnace, molten metals of alloys including the compositions (% by mass) shown in Tables 1 and 2 were prepared, and an ingot was prepared from each molten metal via vacuum casting. After that, the ingots were made into round bars with a diameter of 4.2 mm via hot casting. The round bars were formed into a cup shape, a Cu internal material was inserted to the cup-shaped external materials, and a wire drawing process was performed after a plastic working, such as an extrusion process or the like, so as to make compound materials with a diameter of 2.5 mm. The round bars with a diameter of 4.2 mm were subjected to a wire drawing process, plastic working, or the like so as to become wire rods with a cross-section diameter of 1.6 mm×2.8 mm so that the compound materials and the wire rods were manufactured into the central electrodes of the spark plug specimens and the ground electrodes of the spark plug specimens, respectively.

Additionally, via a well-known method, one end of the ground electrode was connected to one end surface of the metal shell, and, subsequently, the central electrode was combined with an insulator formed from ceramic so that the insulator was combined with the metal shell to which the ground electrode was connected. In addition, a spark plug specimen was manufactured by bending the leading end portion of the ground electrode toward the central electrode so that one end of the ground electrode faced the leading end of the central electrode.

Meanwhile, the screw diameter of the manufactured spark plug specimens was M14, and the measurement of the projected central electrode with a length from the end surface of the insulator to the end surface of the central electrode projecting in the axis direction was 3 mm, the measurement of the projected insulator with a length from the end surface of the metal shell to the end surface of the insulator projecting in the axis direction was 3 mm, and the spark discharge gap between the end surface of the central electrode and the surface of the ground electrode facing the central electrode was 1.1 mm.

<Evaluation Method>

(Formation of Corrosion-Like Generated Foreign Substances)

The spark plug specimens manufactured in the above manner were mounted on 2000 cc six-cylinder gasoline engines, and the engines were operated for 100 hours to 200 hours in a fully open throttle state while maintaining the revolutions per minute of the engines at 5000 rpm. Here, unleaded gasoline was used as a fuel.

With regard to the formation state of corrosion-like generated foreign substances, whether or not corrosion-like generated foreign substances were formed on the surface of the ground electrode was visually determined using a magnifier (× 50), and evaluation was performed based on the following criteria. The results are shown in Tables 1 and 2.

D: corrosion-like generated foreign substances were observed with 100 hours of operation.

C: corrosion-like generated foreign substances were observed with 150 hours of operation.

B: corrosion-like generated foreign substances were observed with 200 hours of operation.

A: No corrosion-like generated foreign substances were observed with 200 hours of operation.

(Strength Test)

The spark plug specimens manufactured in the above manner were heated so that the ground electrodes reached 1000° C., vibration tests were performed at a frequency of Hz and an acceleration of 30 G, and evaluation was performed based on the following criteria. The results are shown in Tables 1 and 2.

D: The specimen was broken after less than 4 hours of the vibration test.

C: The specimen was broken after 4 hours or longer and less than 8 hours of the vibration test.

B: The specimen was not broken during 8 hours of the vibration test.

(Thermal Conductivity Test)

Spark plugs having the same dimensions as the spark plug specimens manufactured in the above manner and having the external material of the central electrode and the ground electrode formed from pure Ni were heated with a burner so that the temperatures of the ground electrodes became 1000° C. In the same conditions as the above heating conditions, the spark plug specimens manufactured in the above manner were heated with a burner, the temperatures of the ground electrodes were measured with a radiation thermometer, and evaluation was performed based on the following criteria. The results are shown in Tables 1 and 2.

D: The temperature of the ground electrode exceeded 1050° C.

C: The temperature of the ground electrode was in a range of 1000° C. to 1050° C.

TABLE 1

| | Comp. No | Ni | Si | Cr | Mn | Al | Ti, V, Nb Element | Ti, V, Nb Content | Ti, V, Nb Element | Ti, V, Nb Content | Y | Rare earth element Element | Rare earth element Content | (% by mass) C | (% by mass) Total | a/b | Determination: corrosion-like generated foreign substances | Determination: Thermal conductivity | Determination: Strength | Determination: General evaluation |
|---|---|---|---|---|---|---|---|---|---|---|---|---|---|---|---|---|---|---|---|---|
| Comparative Example 1 | 1 | 98.565 | 1.10 | 0.10 | 0.10 | 0.03 | | | | | 0.10 | | | 0.005 | 100 | — | D | C | B | D |
| Comparative Example 2 | 2 | 97.665 | 1.10 | 0.10 | 1.00 | 0.03 | | | | | 0.10 | | | 0.005 | 100 | — | D | C | B | D |
| Comparative Example 3 | 3 | 96.665 | 1.10 | 0.10 | 2.00 | 0.03 | | | | | 0.10 | | | 0.005 | 100 | — | D | C | B | D |
| Comparative Example 4 | 4 | 98.635 | 1.10 | 0.10 | 0.01 | 0.03 | Ti | 0.02 | | | 0.10 | | | 0.005 | 100 | 2.00 | D | C | B | D |
| Comparative Example 5 | 5 | 98.615 | 1.10 | 0.10 | 0.03 | 0.03 | Ti | 0.02 | | | 0.10 | | | 0.005 | 100 | 0.67 | D | C | B | D |
| Comparative Example 6 | 6 | 98.605 | 1.10 | 0.10 | 0.04 | 0.03 | Ti | 0.02 | | | 0.10 | | | 0.005 | 100 | 0.50 | D | C | B | D |
| Comparative Example 7 | 7 | 98.601 | 1.10 | 0.10 | 0.04 | 0.03 | Ti | 0.02 | | | 0.10 | | | 0.005 | 100 | 0.45 | D | C | B | D |
| Comparative Example 8 | 8 | 98.597 | 1.10 | 0.10 | 0.05 | 0.03 | Ti | 0.02 | | | 0.10 | | | 0.005 | 100 | 0.42 | D | C | B | D |
| Example 1 | 9 | 98.595 | 1.10 | 0.10 | 0.05 | 0.03 | Ti | 0.02 | | | 0.10 | | | 0.005 | 100 | 0.40 | C | C | B | C |
| Example 2 | 10 | 98.575 | 1.10 | 0.10 | 0.07 | 0.03 | Ti | 0.02 | | | 0.10 | | | 0.005 | 100 | 0.29 | B | C | B | B |
| Example 3 | 11 | 98.505 | 1.10 | 0.10 | 0.14 | 0.03 | Ti | 0.02 | | | 0.10 | | | 0.005 | 100 | 0.14 | A | C | B | A |
| Example 4 | 12 | 98.195 | 1.10 | 0.10 | 0.45 | 0.03 | Ti | 0.02 | | | 0.10 | | | 0.005 | 100 | 0.04 | A | C | B | A |
| Example 5 | 13 | 97.945 | 1.10 | 0.10 | 0.70 | 0.03 | Ti | 0.02 | | | 0.10 | | | 0.005 | 100 | 0.03 | B | C | B | B |
| Example 6 | 14 | 97.645 | 1.10 | 0.10 | 1.00 | 0.03 | Ti | 0.02 | | | 0.10 | | | 0.005 | 100 | 0.02 | C | C | B | C |
| Comparative Example 9 | 15 | 96.645 | 1.10 | 0.10 | 2.00 | 0.03 | Ti | 0.02 | | | 0.10 | | | 0.005 | 100 | 0.01 | D | C | B | D |
| Comparative Example 10 | 16 | 98.595 | 1.10 | 0.10 | 0.01 | 0.03 | Ti | 0.06 | | | 0.10 | | | 0.005 | 100 | 6.00 | D | C | B | D |
| Comparative Example 11 | 17 | 98.485 | 1.10 | 0.10 | 0.12 | 0.03 | Ti | 0.06 | | | 0.10 | | | 0.005 | 100 | 0.50 | D | C | B | D |
| Comparative Example 12 | 18 | 98.465 | 1.10 | 0.10 | 0.14 | 0.03 | Ti | 0.06 | | | 0.10 | | | 0.005 | 100 | 0.43 | D | C | B | D |
| Example 7 | 19 | 98.455 | 1.10 | 0.10 | 0.15 | 0.03 | Ti | 0.06 | | | 0.10 | | | 0.005 | 100 | 0.40 | C | C | B | C |
| Example 8 | 20 | 98.395 | 1.10 | 0.10 | 0.21 | 0.03 | Ti | 0.06 | | | 0.10 | | | 0.005 | 100 | 0.29 | B | C | B | B |
| Example 9 | 21 | 98.175 | 1.10 | 0.10 | 0.43 | 0.03 | Ti | 0.06 | | | 0.10 | | | 0.005 | 100 | 0.14 | A | C | B | A |
| Example 10 | 22 | 97.605 | 1.10 | 0.10 | 1.00 | 0.03 | Ti | 0.06 | | | 0.10 | | | 0.005 | 100 | 0.06 | A | C | B | A |
| Example 11 | 23 | 97.205 | 1.10 | 0.10 | 1.40 | 0.03 | Ti | 0.06 | | | 0.10 | | | 0.005 | 100 | 0.04 | A | C | B | A |
| Example 12 | 24 | 96.605 | 1.10 | 0.10 | 2.00 | 0.03 | Ti | 0.06 | | | 0.10 | | | 0.005 | 100 | 0.03 | B | C | B | B |
| Example 13 | 25 | 96.105 | 1.10 | 0.10 | 2.50 | 0.03 | Ti | 0.06 | | | 0.10 | | | 0.005 | 100 | 0.02 | C | C | B | C |

TABLE 1-continued

| | Comp. | | | | | | Ti, V, Nb | | | | | Rare earth element | | (% by mass) | | | Determination | | | |
|---|---|---|---|---|---|---|---|---|---|---|---|---|---|---|---|---|---|---|---|---|
| | | | | | | | | | | | | | | | | | corrosion-like generated | Thermal | | General |
| | No | Ni | Si | Cr | Mn | Al | Element | Content | Element | Content | Y | Element | Content | C | Total | a/b | foreign substances | conductivity | Strength | evaluation |
| Example 14 | 26 | 98.315 | 1.10 | 0.10 | 0.25 | 0.03 | Ti | 0.10 | | | 0.10 | | | 0.005 | 100 | 0.40 | C | C | B | C |
| Example 15 | 27 | 98.215 | 1.10 | 0.10 | 0.35 | 0.03 | Ti | 0.10 | | | 0.10 | | | 0.005 | 100 | 0.29 | B | C | B | B |
| Example 16 | 28 | 97.865 | 1.10 | 0.10 | 0.70 | 0.03 | Ti | 0.10 | | | 0.10 | | | 0.005 | 100 | 0.14 | A | C | B | A |
| Example 17 | 29 | 96.065 | 1.10 | 0.10 | 2.50 | 0.03 | Ti | 0.10 | | | 0.10 | | | 0.005 | 100 | 0.04 | A | C | B | A |
| Example 18 | 30 | 96.465 | 0.20 | 0.10 | 3.00 | 0.03 | Ti | 0.10 | | | 0.10 | | | 0.005 | 100 | 0.03 | B | C | B | B |

a/b: (the total content of Ti, V, and Nb)/(the content of Mn)

TABLE 2

| | Comp. | | | | | | Ti, V, Nb | | | | | Rare earth element | | (% by mass) | | | Determination | | | |
|---|---|---|---|---|---|---|---|---|---|---|---|---|---|---|---|---|---|---|---|---|
| | No | Ni | Si | Cr | Mn | Al | Element | Content | Element | Content | Y | Element | Content | C | Total | a/b | corrosion-like generated foreign substances | Thermal conductivity | Strength | General evaluation |
| Comparative Example 13 | 31 | 97.705 | 1.10 | 0.10 | 1.00 | 0.03 | Ti | 0.06 | | | 0.00 | | | 0.005 | 100 | 0.06 | A | C | D | D |
| Comparative Example 14 | 32 | 97.675 | 1.10 | 0.10 | 1.00 | 0.03 | Ti | 0.06 | | | 0.03 | | | 0.005 | 100 | 0.06 | A | C | D | D |
| Comparative Example 15 | 33 | 97.675 | 1.10 | 0.10 | 1.00 | 0.03 | Ti | 0.06 | | | 0.00 | La | 0.03 | 0.005 | 100 | 0.06 | A | C | D | D |
| Example 19 | 34 | 97.655 | 1.10 | 0.10 | 1.00 | 0.03 | Ti | 0.06 | | | 0.05 | | | 0.005 | 100 | 0.06 | A | C | B | A |
| Example 20 | 35 | 97.255 | 1.10 | 0.10 | 1.00 | 0.03 | Ti | 0.06 | | | 0.45 | | | 0.005 | 100 | 0.06 | A | C | B | A |
| Comparative Example 16 | 36 | 97.105 | 1.10 | 0.10 | 1.00 | 0.03 | Ti | 0.06 | | | 0.60 | | | 0.005 | 100 | 0.06 | D | C | B | D |
| Example 21 | 37 | 97.255 | 1.10 | 0.10 | 1.00 | 0.03 | Ti | 0.06 | | | 0.10 | Nd | 0.35 | 0.005 | 100 | 0.06 | A | C | B | A |
| Example 22 | 38 | 97.255 | 1.10 | 0.10 | 1.00 | 0.03 | Ti | 0.06 | | | 0.00 | Nd | 0.45 | 0.005 | 100 | 0.06 | A | C | B | A |
| Example 23 | 39 | 97.655 | 1.10 | 0.10 | 1.00 | 0.03 | Ti | 0.06 | | | 0.00 | La | 0.05 | 0.005 | 100 | 0.06 | A | C | B | A |
| Example 24 | 40 | 97.655 | 1.10 | 0.10 | 1.00 | 0.03 | Ti | 0.06 | | | 0.00 | Ce | 0.05 | 0.005 | 100 | 0.06 | A | C | B | A |
| Example 25 | 41 | 97.655 | 1.10 | 0.10 | 1.00 | 0.03 | Ti | 0.06 | | | 0.00 | Dy | 0.05 | 0.005 | 100 | 0.06 | A | C | B | A |
| Example 26 | 42 | 97.655 | 1.10 | 0.10 | 1.00 | 0.03 | Ti | 0.06 | | | 0.00 | Er | 0.05 | 0.005 | 100 | 0.06 | A | C | B | A |
| Example 27 | 43 | 97.655 | 1.10 | 0.10 | 1.00 | 0.03 | Ti | 0.06 | | | 0.00 | Yb | 0.05 | 0.005 | 100 | 0.06 | A | C | B | A |
| Example 28 | 44 | 97.609 | 1.10 | 0.10 | 1.00 | 0.03 | Ti | 0.06 | | | 0.10 | | | 0.001 | 100 | 0.06 | A | C | C | B |
| Example 29 | 45 | 97.607 | 1.10 | 0.10 | 1.00 | 0.03 | Ti | 0.06 | | | 0.10 | | | 0.003 | 100 | 0.06 | A | C | C | B |
| Example 30 | 46 | 97.600 | 1.10 | 0.10 | 1.00 | 0.03 | Ti | 0.06 | | | 0.10 | | | 0.010 | 100 | 0.06 | A | C | B | A |
| Example 31 | 47 | 97.560 | 1.10 | 0.10 | 1.00 | 0.03 | Ti | 0.06 | | | 0.10 | | | 0.050 | 100 | 0.06 | A | C | B | A |
| Example 32 | 48 | 98.705 | 0.00 | 0.10 | 1.00 | 0.03 | Ti | 0.06 | | | 0.10 | | | 0.005 | 100 | 0.06 | B | C | B | B |
| Example 33 | 49 | 98.555 | 0.15 | 0.10 | 1.00 | 0.03 | Ti | 0.06 | | | 0.10 | | | 0.005 | 100 | 0.06 | A | C | B | A |
| Example 34 | 50 | 97.905 | 0.80 | 0.10 | 1.00 | 0.03 | Ti | 0.06 | | | 0.10 | | | 0.005 | 100 | 0.06 | A | C | B | A |

TABLE 2-continued

| | Comp. | | | | | | Ti, V, Nb | | | | | Rare earth element | | (% by mass) | | | Determination | | | |
|---|---|---|---|---|---|---|---|---|---|---|---|---|---|---|---|---|---|---|---|---|
| | | | | | | | | | | | | | | | | | corrosion-like generated | Thermal | | General |
| | No | Ni | Si | Cr | Mn | Al | Element | Content | Element | Content | Y | Element | Content | C | Total | a/b | foreign substances | conductivity | Strength | evaluation |
| Example 35 | 51 | 97.205 | 1.50 | 0.10 | 1.00 | 0.03 | Ti | 0.06 | | | 0.10 | | | 0.005 | 100 | 0.06 | A | C | B | A |
| Example 36 | 52 | 96.205 | 2.50 | 0.10 | 1.00 | 0.03 | Ti | 0.06 | | | 0.10 | | | 0.005 | 100 | 0.06 | B | C | B | B |
| Comparative Example 17 | 53 | 93.705 | 5.00 | 0.10 | 1.00 | 0.03 | Ti | 0.06 | | | 0.10 | | | 0.005 | 100 | 0.06 | C | D | B | D |
| Comparative Example 18 | 54 | 93.705 | 0.10 | 5.00 | 1.00 | 0.03 | Ti | 0.06 | | | 0.10 | | | 0.005 | 100 | 0.06 | C | D | B | D |
| Comparative Example 19 | 55 | 95.805 | 2.30 | 0.70 | 1.00 | 0.03 | Ti | 0.06 | | | 0.10 | | | 0.005 | 100 | 0.06 | B | D | B | D |
| Comparative Example 20 | 56 | 95.805 | 2.10 | 0.90 | 1.00 | 0.03 | Ti | 0.06 | | | 0.10 | | | 0.005 | 100 | 0.06 | C | D | B | D |
| Comparative Example 21 | 57 | 95.805 | 1.70 | 1.30 | 1.00 | 0.03 | Ti | 0.06 | | | 0.10 | | | 0.005 | 100 | 0.06 | C | D | B | D |
| Comparative Example 22 | 58 | 95.805 | 1.00 | 2.00 | 1.00 | 0.03 | Ti | 0.06 | | | 0.10 | | | 0.005 | 100 | 0.06 | C | D | B | D |
| Example 37 | 59 | 98.485 | 1.10 | 0.10 | 0.15 | 0.00 | Ti | 0.06 | | | 0.10 | | | 0.005 | 100 | 0.40 | B | C | B | B |
| Example 38 | 60 | 98.385 | 1.10 | 0.10 | 0.15 | 0.10 | Ti | 0.06 | | | 0.10 | | | 0.005 | 100 | 0.40 | A | C | B | A |
| Example 39 | 61 | 98.395 | 1.10 | 0.10 | 0.24 | 0.00 | Ti | 0.06 | | | 0.10 | | | 0.005 | 100 | 0.25 | B | C | B | B |
| Example 40 | 62 | 98.385 | 1.10 | 0.10 | 0.24 | 0.01 | Ti | 0.06 | | | 0.10 | | | 0.005 | 100 | 0.25 | A | C | B | A |
| Example 41 | 63 | 98.295 | 1.10 | 0.10 | 0.24 | 0.10 | Ti | 0.06 | | | 0.10 | | | 0.005 | 100 | 0.25 | A | C | B | A |
| Example 42 | 64 | 97.635 | 1.10 | 0.10 | 1.00 | 0.00 | Ti | 0.06 | | | 0.10 | | | 0.005 | 100 | 0.06 | B | C | B | B |
| Example 43 | 65 | 97.625 | 1.10 | 0.10 | 1.00 | 0.01 | Ti | 0.06 | | | 0.10 | | | 0.005 | 100 | 0.06 | A | C | B | A |
| Example 44 | 66 | 97.535 | 1.10 | 0.10 | 1.00 | 0.10 | Ti | 0.06 | | | 0.10 | | | 0.005 | 100 | 0.06 | A | C | B | A |
| Example 45 | 67 | 97.435 | 1.10 | 0.10 | 1.00 | 0.20 | Ti | 0.06 | | | 0.10 | | | 0.005 | 100 | 0.06 | B | C | B | B |
| Example 46 | 68 | 98.555 | 1.10 | 0.00 | 0.15 | 0.03 | Ti | 0.06 | | | 0.10 | | | 0.005 | 100 | 0.40 | B | C | B | B |
| Example 47 | 69 | 98.505 | 1.10 | 0.05 | 0.15 | 0.03 | Ti | 0.06 | | | 0.10 | | | 0.005 | 100 | 0.40 | A | C | B | A |
| Example 48 | 70 | 97.555 | 1.10 | 1.00 | 0.15 | 0.03 | Ti | 0.06 | | | 0.10 | | | 0.005 | 100 | 0.40 | A | C | B | A |

TABLE 2-continued

| | Comp. | | | | | | Ti, V, Nb | | | | | Rare earth element | | (% by mass) | | | Determination | | | |
|---|---|---|---|---|---|---|---|---|---|---|---|---|---|---|---|---|---|---|---|---|
| | No | Ni | Si | Cr | Mn | Al | Element | Content | Element | Content | Y | Element | Content | C | Total | a/b | corrosion-like generated foreign substances | Thermal conductivity | Strength | General evaluation |
| Example 49 | 71 | 98.485 | 1.10 | 0.00 | 0.24 | 0.03 | Ti | 0.06 | | | 0.10 | | | 0.005 | 100 | 0.25 | B | C | B | B |
| Example 50 | 72 | 98.415 | 1.10 | 0.05 | 0.24 | 0.03 | Ti | 0.06 | | | 0.10 | | | 0.005 | 100 | 0.25 | A | C | B | A |
| Example 51 | 73 | 97.965 | 1.10 | 0.50 | 0.24 | 0.03 | Ti | 0.06 | | | 0.10 | | | 0.005 | 100 | 0.25 | A | C | B | A |
| Example 52 | 74 | 97.465 | 1.10 | 1.00 | 0.24 | 0.03 | Ti | 0.06 | | | 0.10 | | | 0.005 | 100 | 0.25 | B | C | B | B |
| Example 53 | 75 | 97.705 | 1.10 | 0.00 | 1.00 | 0.03 | Ti | 0.06 | | | 0.10 | | | 0.005 | 100 | 0.06 | B | C | B | B |
| Example 54 | 76 | 97.655 | 1.10 | 0.05 | 1.00 | 0.03 | Ti | 0.06 | | | 0.10 | | | 0.005 | 100 | 0.06 | A | C | B | A |
| Example 55 | 77 | 97.405 | 1.10 | 0.30 | 1.00 | 0.03 | Ti | 0.06 | | | 0.10 | | | 0.005 | 100 | 0.06 | A | C | B | A |
| Example 56 | 78 | 97.205 | 1.10 | 0.50 | 1.00 | 0.03 | Ti | 0.06 | | | 0.10 | | | 0.005 | 100 | 0.06 | A | C | B | A |
| Example 57 | 79 | 96.705 | 1.10 | 1.00 | 1.00 | 0.03 | Ti | 0.06 | | | 0.10 | | | 0.005 | 100 | 0.06 | B | C | B | B |
| Example 58 | 80 | 98.595 | 1.10 | 0.10 | 0.05 | 0.03 | | | V | 0.02 | 0.10 | | | 0.005 | 100 | 0.40 | C | C | B | C |
| Example 59 | 81 | 98.595 | 1.10 | 0.10 | 0.05 | 0.03 | Ti | 0.01 | V | 0.01 | 0.10 | | | 0.005 | 100 | 0.40 | C | C | B | C |
| Example 60 | 82 | 98.595 | 1.10 | 0.10 | 0.05 | 0.03 | | | Nb | 0.02 | 0.10 | | | 0.005 | 100 | 0.40 | C | C | B | C |
| Example 61 | 83 | 98.595 | 1.10 | 0.10 | 0.05 | 0.03 | Ti | 0.01 | Nb | 0.01 | 0.10 | | | 0.005 | 100 | 0.40 | C | C | B | C |
| Example 62 | 84 | 97.605 | 1.10 | 0.10 | 1.00 | 0.03 | | | V | 0.06 | 0.10 | | | 0.005 | 100 | 0.06 | A | C | B | A |
| Example 63 | 85 | 97.605 | 1.10 | 0.10 | 1.00 | 0.03 | Ti | 0.03 | V | 0.03 | 0.10 | | | 0.005 | 100 | 0.06 | A | C | B | A |
| Example 64 | 86 | 97.605 | 1.10 | 0.10 | 1.00 | 0.03 | | | Nb | 0.06 | 0.10 | | | 0.005 | 100 | 0.06 | A | C | B | A |
| Example 65 | 87 | 97.605 | 1.10 | 0.10 | 1.00 | 0.03 | Ti | 0.03 | Nb | 0.03 | 0.10 | | | 0.005 | 100 | 0.06 | A | C | B | A |

a/b: (the total content of Ti, V, and Nb)/(the content of Mn)

As shown in Tables 1 and 2, the spark plugs including electrodes formed from the electrode material included in the scope of the invention are resistant to formation of corrosion-like generated foreign substances, and have high strength and high thermal conductivity.

On the other hand, as shown in Tables 1 and 2, the spark plugs including electrodes formed from the electrode material not included in the scope of the invention are poor in terms of at least one property of formation of corrosion-like generated foreign substances, strength, and thermal conductivity.

Comparative Examples 1 to 3 did not include Ti, V, and Nb, and Comparative Examples 4 to 8 had a content of Mn and the ratios (a/b) outside the scope of the invention so that all of these were evaluated as poor in terms of formation of corrosion-like generated foreign substances. Comparative Examples 9 to 12 had the ratios (a/b) outside the scope of the invention so that all of these were evaluated as poor in terms of formation of corrosion-like generated foreign substances. Comparative Examples 13 to 15 had a content of Y and/or rare earth elements smaller than the scope of the invention and were evaluated as poor in terms of strength. Comparative Example 16 had a content of Y and/or rare earth elements larger than the scope of the invention and was evaluated as poor in terms of formation of corrosion-like generated foreign substances. Comparative Examples 17 to 22 had a content of Ni smaller than the scope of the invention and were evaluated as poor in terms of the thermal conduction rate.

| Reference Signs List | |
|---|---|
| 1, 101, 102 | SPARK PLUG |
| 2 | CENTRAL ELECTRODE |
| 3 | INSULATOR |
| 4 | METAL SHELL |
| 6, 61, 62 | GROUND ELECTRODE |
| 7 | EXTERNAL MATERIAL |
| 8 | INTERNAL MATERIAL |
| 0 | SCREW PORTION |
| 10 | TALC |
| 11 | PACKING |
| 12, 14 | EXTERNAL LAYER |
| 13, 15 | AXIS PORTION |

-continued

| Reference Signs List | |
|---|---|
| 16 | INTERMEDIATE LAYER |
| G | SPARK DISCHARGE GAP |

The invention claimed is:

1. A spark plug comprising a central electrode and a ground electrode provided to have a gap between the central electrode and the ground electrode with at least one of the central electrode and the ground electrode formed from an electrode material including 96% by mass or more of Ni, wherein the electrode material includes a total content of from 0.05% by mass to 0.45% by mass of at least one selected from a group consisting of Y and rare earth elements, 0.05% by mass or more of Mn, and a total content of 0.01% by mass or more of at least one selected from a group consisting of Ti, V, and Nb, and the ratio (a/b) of the total content (a) of Ti, V, and Nb to the content (b) of Mn is from 0.02 to 0.40.

2. The spark plug according to claim 1, wherein the ratio (a/b) is from 0.03 to 0.29.

3. The spark plug according to claim 1, wherein the ratio (a/b) is from 0.04 to 0.14.

4. The spark plug according to claim 1, wherein the electrode material includes from 0.15% by mass to 1.5% by mass of Si.

5. The spark plug according to claim 1, wherein the electrode material includes from 0.01% by mass to 0.1% by mass of Al.

6. The spark plug according to claim 1, wherein the electrode material includes from 0.05% by mass to 0.5% by mass of Cr.

7. The spark plug according to claim 1, wherein the electrode material includes 0.005% by mass or more of C.

8. The spark plug according to claim 1, wherein the electrode material includes Ti.

9. The spark plug according to claim 1, wherein at least the ground electrode is formed from the electrode material.

* * * * *